US010321740B2

(12) United States Patent
Cheng

(10) Patent No.: US 10,321,740 B2
(45) Date of Patent: Jun. 18, 2019

(54) SHOE TREE

(71) Applicant: Chao-Yuan Cheng, Changhua (TW)

(72) Inventor: Chao-Yuan Cheng, Changhua (TW)

( * ) Notice: Subject to any disclaimer, the term of this patent is extended or adjusted under 35 U.S.C. 154(b) by 6 days.

(21) Appl. No.: 15/825,360

(22) Filed: Nov. 29, 2017

(65) Prior Publication Data

US 2018/0192741 A1 Jul. 12, 2018

(30) Foreign Application Priority Data

Jan. 11, 2017 (TW) ..... 106200517 U

(51) Int. Cl.
*A43D 3/14* (2006.01)

(52) U.S. Cl.
CPC ..... *A43D 3/1433* (2013.01)

(58) Field of Classification Search
CPC ..... A43D 3/1433–1483
See application file for complete search history.

(56) References Cited

U.S. PATENT DOCUMENTS 812,315 A * 2/1906 Wilder ..... A43D 3/1475 12/117.2
921,263 A * 5/1909 Mason ..... A43D 3/1433 12/128 R
2,270,936 A * 1/1942 Doering ..... A43D 3/1466 12/114.6
2,361,531 A * 10/1944 Clausing ..... A43D 3/1441 12/116.6
2,378,337 A * 6/1945 Suszholz ..... A43D 3/1483 12/117.4
2,595,736 A * 5/1952 Troutfetter ..... A43D 3/1475 12/117.4
3,296,637 A * 1/1967 Fleisig ..... A43D 3/1475 12/115.6
6,202,240 B1 * 3/2001 Tsung-Ping ..... A43D 3/1433 12/114.2
2006/0207039 A1 * 9/2006 Huang ..... A43D 3/1433 12/128 R

* cited by examiner

*Primary Examiner* — Ted Kavanaugh
(74) *Attorney, Agent, or Firm* — Rosenberg, Klein & Lee

(57) ABSTRACT

A shoe tree includes a front section and a rear section which is pivotably connected to the rear end of the front section. The front section has a vamp portion on the top thereof. A first recessed area is defined in the underside of the front section. The rear end of the front section has a first support face and a first opening which communicates with the first recessed area. The rear section is pivotably connected to the first support face. Two notches are defined in two lateral sides of the shoe tree and located between the front and rear sections. The two notches are narrowed and widened when the rear section is pivoted downward and upward relative to the front section. The front section is inserted into a shoe by push and pivoting the rear section, and then the rear section is inserted into the shoe.

3 Claims, 6 Drawing Sheets

SHOE TREE

BACKGROUND OF THE INVENTION

1. Fields of the invention

The present invention relates to a shoe tree, and more particularly, to a shoe tree with a front section and a rear section which is pivotably connected to the front section so as to maintain the shoe shape.

2. Descriptions of Related Art

The conventional way for maintaining the shoes with their proper shapes is to stuff paper, foam material, bubble sheets, plastic shoe trees or paper-made shoe trees in the shoes. The stuff supports the vamps of the shoes and prevents the vamps from being deformed. However, the paper-made or plastic made shoe trees are not able to be reused for a long time, and the plastic-made shoe trees may cause environment concerns. The paper-made shoe trees are not strong enough so that when inserting the paper-made shoe trees, the shoe trees are often deformed or flatted, and the deformed shoe trees cannot well support the shoes. The front portion of the paper-made shoe trees is required to be snugly inserted into the shoes, and the rear portion of the shoe trees may not easily to be inserted into the shoes, and this cause the rear portion to be severely deformed. When removing the paper-made shoe tree from the shoe, the users have to grasp the rear portion hard to pull it out from the shoe. This is inconvenient for the users.

The present invention intends to provide a shoe tree that improves the shortcomings mentioned above.

SUMMARY OF THE INVENTION

The present invention relates to a shoe tree and comprises a front section and a rear section which is pivotably connected to the rear end of the front section. The front section has a vamp portion on the top thereof. A first flange extends downward from the front section. A first recessed area is defined in the underside of the front section and partially enclosed by the first flange. A first support face is formed on the top of the rear end of the front section. A first opening is defined between two end faces of the first flange in the rear end of the underside of the front section and communicates with the first recessed area.

The rear section has the first end thereof pivotably connected to the first support face at the rear end of the front section. A second flange extends downward from the rear section. Two notches are defined between the two end faces of the first flange and two end faces of the second flange. The two notches are located at a connection portion between the first and second flanges. The rear section has a second support face formed on the top thereof and connected to the first support face. A curved portion is formed at the second end of the rear section.

When applying a force to the rear section to insert the front section into the interior room of a shoe, and the rear section is then pivoted downward relative to the front section to narrow the two notches so that the rear section is inserted into the interior room of the shoe. The curved portion guides the rear section to be accommodated in rear end of the interior room of the shoe.

When lifting and pivoting the rear section, the two notches are widened, and the curved portion is removed from the shoe. The rear section and the front section are able to be pulled out from the interior room of the shoe in sequence.

Preferably, the second support face has a hole defined therethrough. A second recessed area is defined in the underside of the rear section and partially enclosed by the second flange. The hole communicates with the second recessed area which communicates with the first recessed area and the first opening.

Preferably, a lower edge of the second flange of the rear section extends upward and toward the second end of the of the rear section, so as to define a second opening in the second end of the underside of the rear section.

Preferably, a minimum distance defined between second support face to a lower edge of the curved portion is smaller than a maximum distance defined between the second support face to a lower edge of the second flange.

The primary object of the present invention is to provide a shoe tree which allows the user to hold the rear section to guide and control the front section to be inserted into the shoe easily. The first support face reinforces the support force of the front section. The rear section is then pivoted downward and inserted into the shoe. When the rear section is to be inserted into the shoe, the rear section is pivoted downward to narrow the two notches, and the rear section pushes the end faces of the first flange of the front section to further insert the front section into the interior room of the shoe to protect the front end of the shoe from being deformed. The curved portion of the second section makes the second section to be easily fit with the shoe.

When the shoe tree is to be removed from the shoe, the user's finger extends through the hole and pulls and lifts the rear section from the shoe. The user then holds the rear section to pull the front section out from the shoe.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
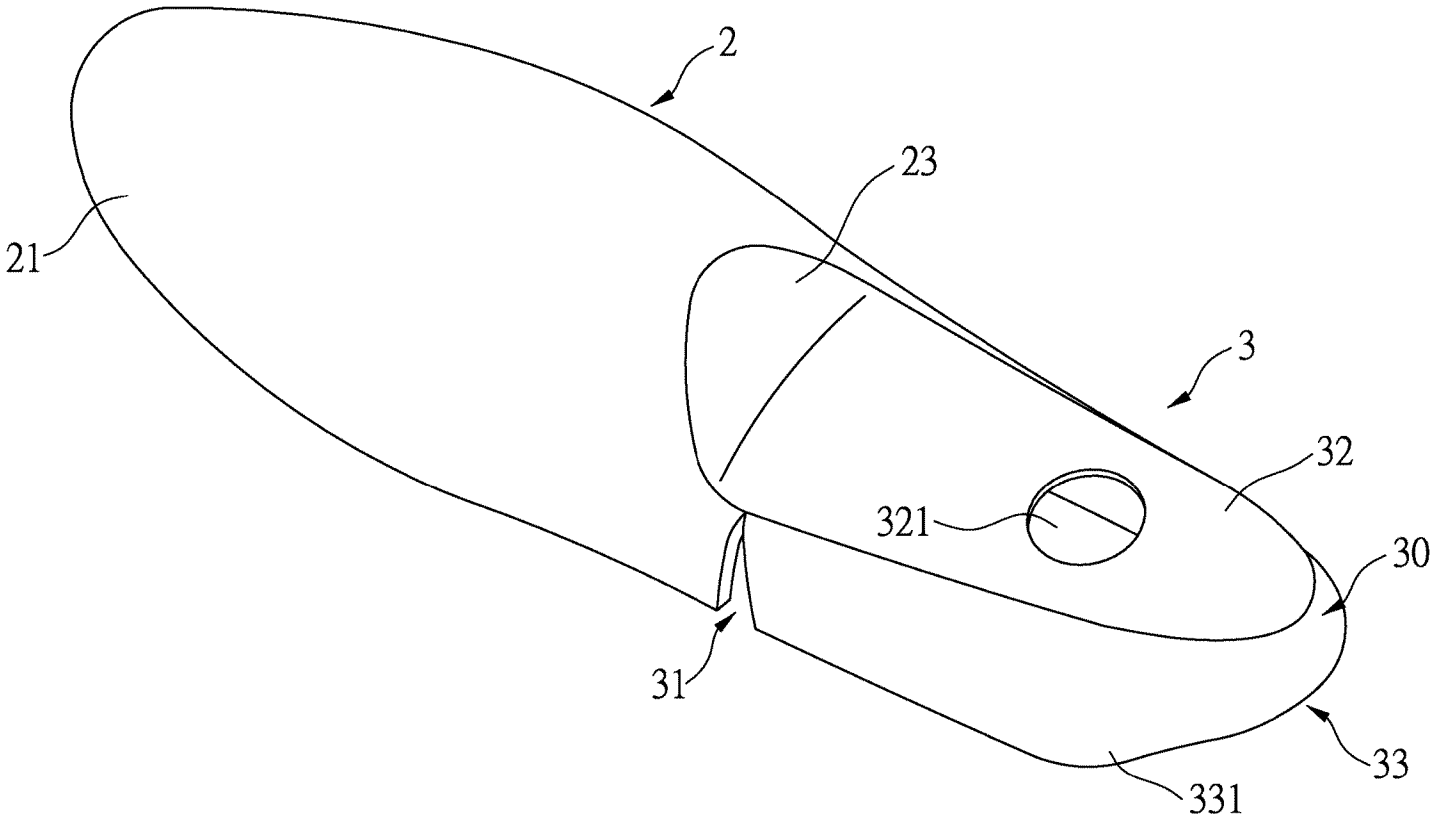
FIG. 1 is a perspective view to show the shoe tree of the present invention.
Figure 2:
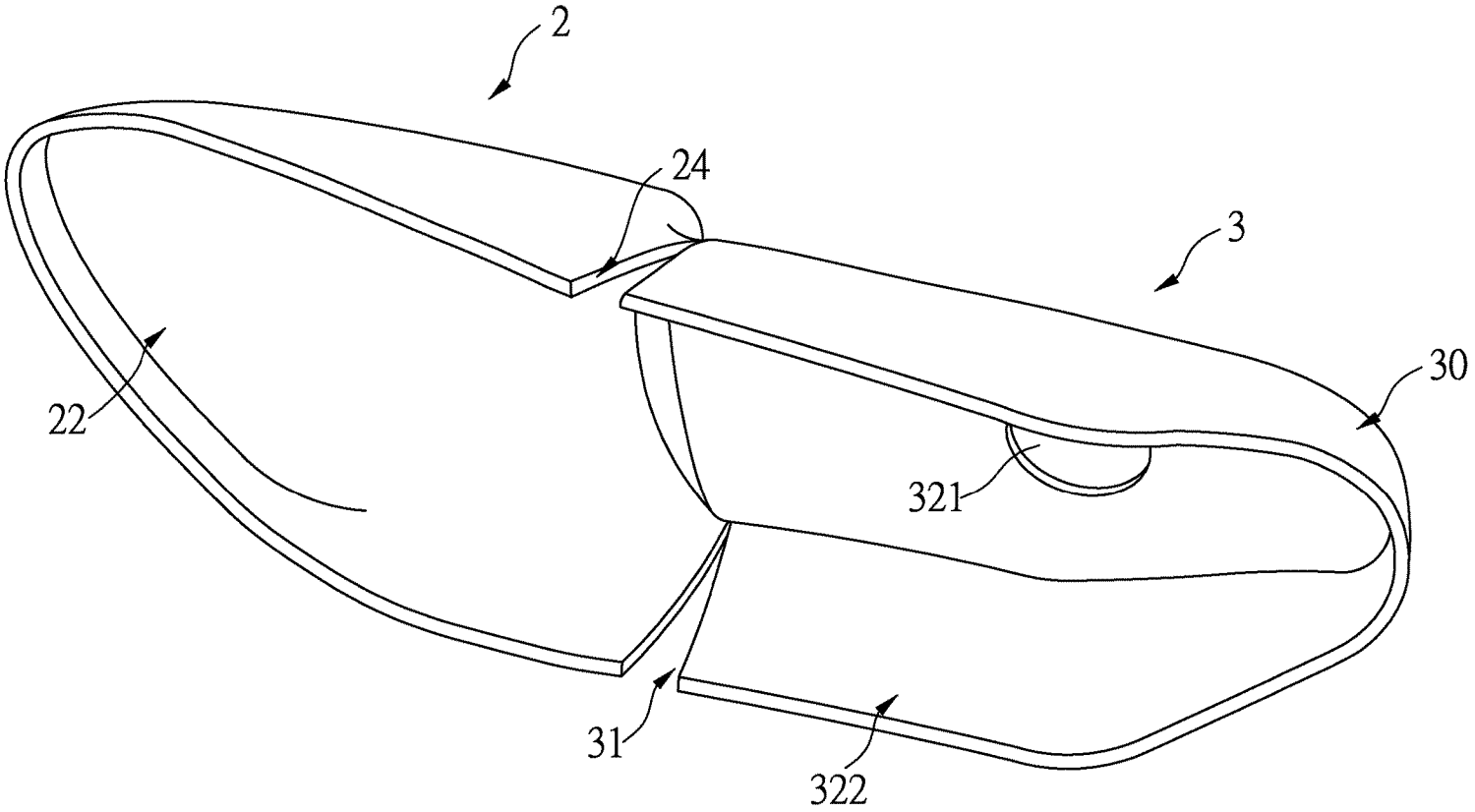
FIG. 2 is another perspective view to show the shoe tree of the present invention.

Referring to FIGS. 1 to 5, the shoe tree of the present invention comprises a front section 2 and a rear section 3 which is pivotably connected to the rear end of the front section 2. The front section 2 has a vamp portion 21 on the top thereof. A first flange extends downward from the front section 2. A first recessed area 22 is defined in the underside of the front section 2 and partially enclosed by the first flange. A first support face 23 is formed on the top of the rear end of the front section 2. A first opening 24 is defined between two end faces of the first flange in the rear end of the underside of the front section 2 and communicates with the first recessed area 22.

The rear section 3 has the first end thereof pivotably connected to the first support face 23 at the rear end of the front section 2. A second flange extends downward from the rear section. Two notches 31 are defined between the two end faces of the first flange and two end faces of the second flange. The two notches 31 are located at a connection portion between the first and second flanges. The rear section 3 has a second support face 32 formed on the top thereof and connected to the first support face 23. The second support face 32 has a hole 321 defined therethrough. A second recessed area 322 is defined in the underside of the rear section 3 and partially enclosed by the second flange. The hole 321 communicates with the second recessed area 322 which communicates with the first recessed area 22 and the first opening 24. A curved portion 30 is formed at the second end of the rear section 3.

The lower edge of the second flange of the rear section 3 extends upward and toward the second end of the of the rear section 3, so as to define a second opening 33 in the second end of the underside of the rear section 3. As shown in FIG. 1, a corner portion 331 is formed at the position where the lower edge of the second flange of the rear section 3 starts to extend upward and toward the second end of the of the rear section 3.

Figure 3:
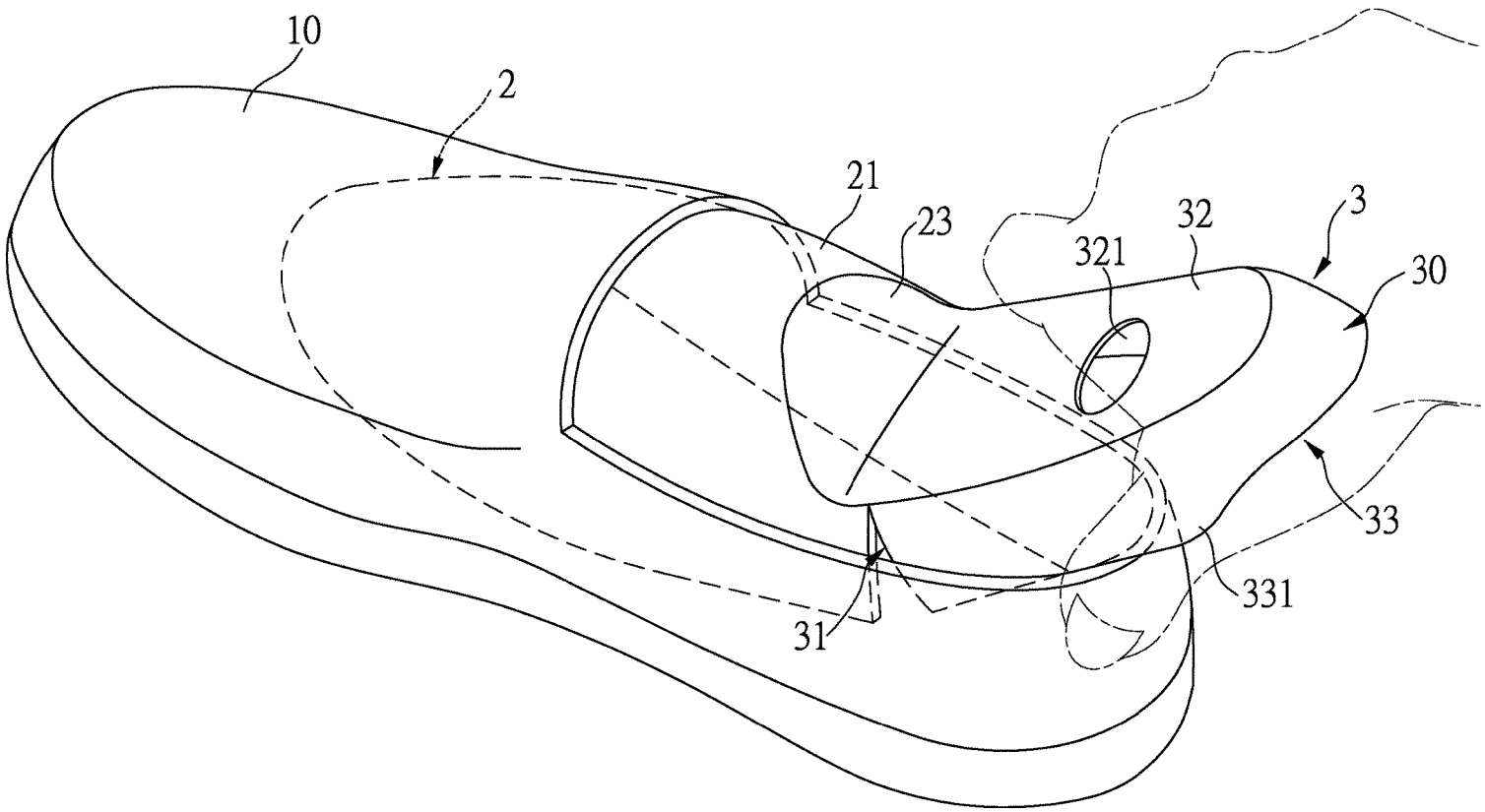
FIG. 3 shows that the rear section is pivoted relative to the front section.
Figure 4:
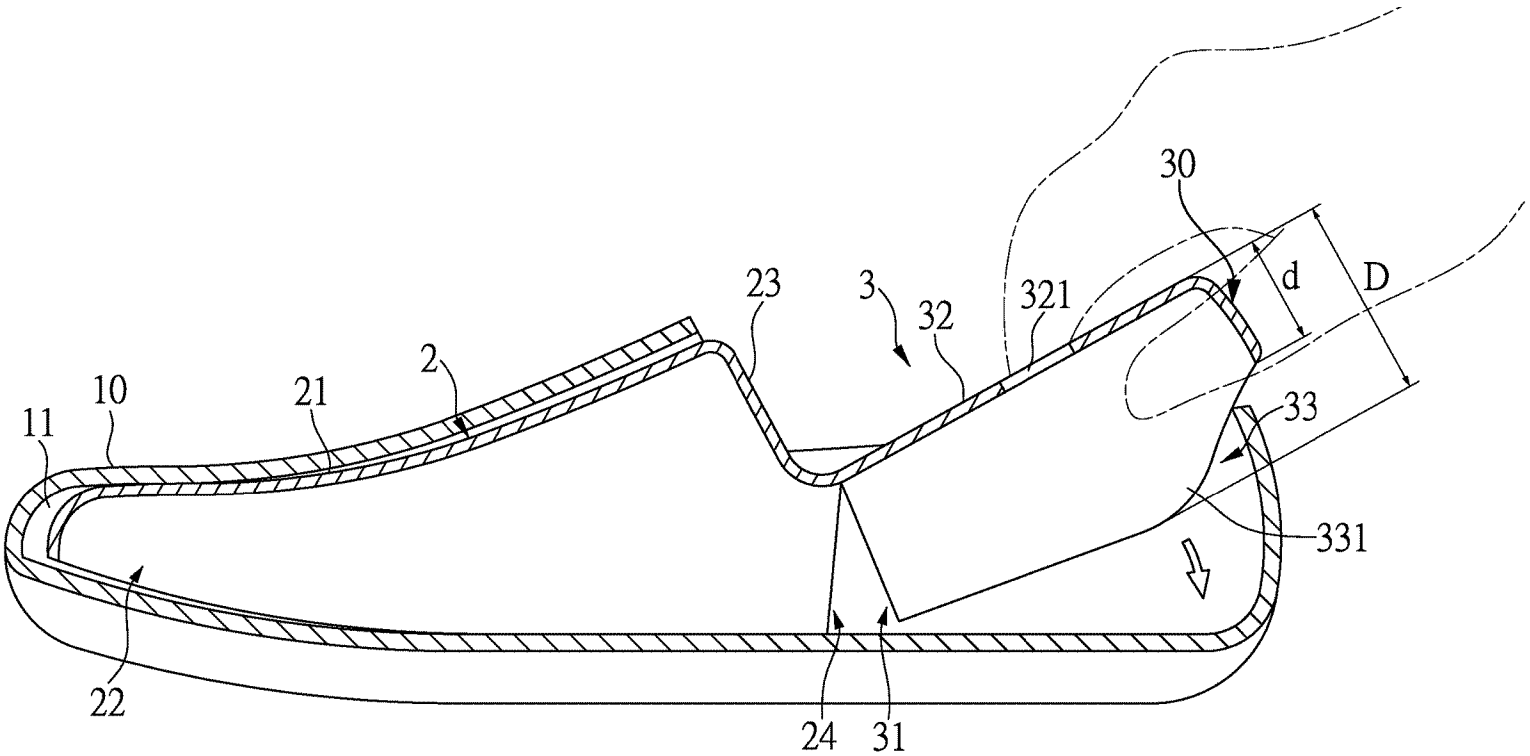
FIG. 4 shows that the front section is inserted into the shoe.
Figure 5:
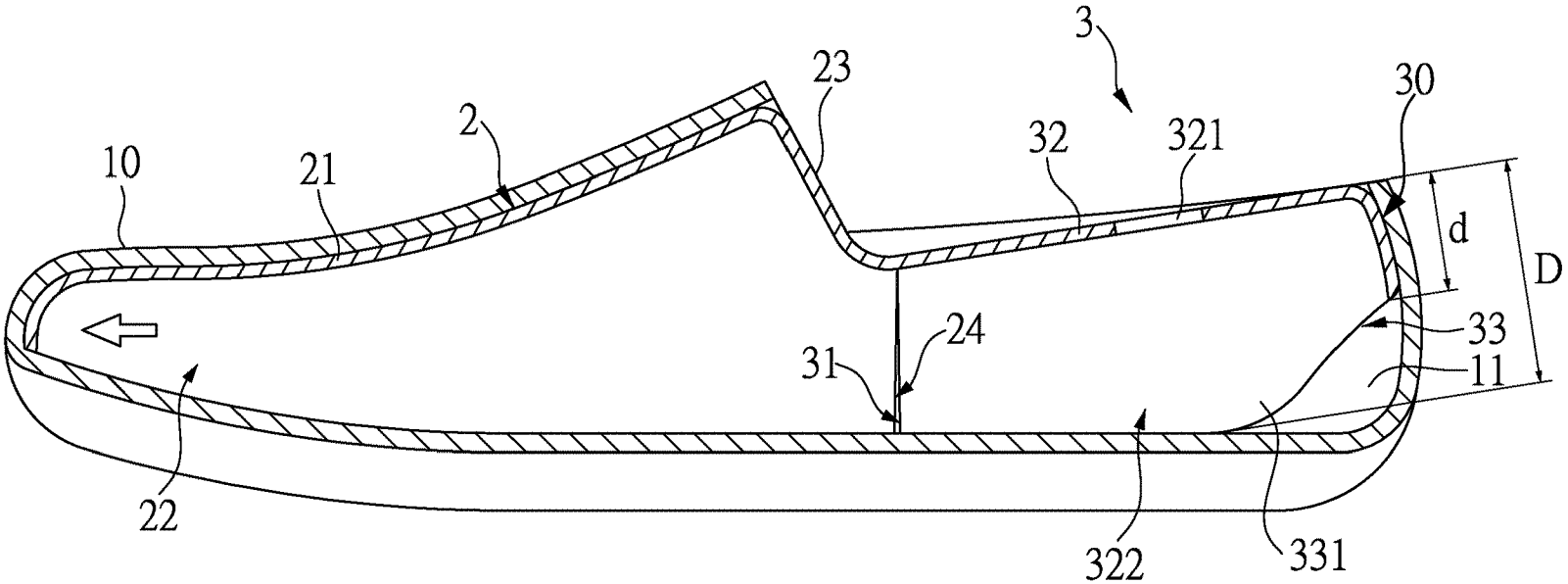
FIG. 5 shows that the rear section is inserted into the shoe.

As shown in FIGS. 3, 4 and 5, the front section 2 is inserted into the interior room 11 of a shoe 10 when applying a force to the rear section 3, and the rear section 3 is then pivoted downward relative to the front section 2 to narrow the two notches 31 so that the rear section 3 is inserted into the interior room 11 of the shoe 10. During the insertion process, the rear section 3 pushes the end faces of the first flange of the front section 2 to further insert the front section 2 into the interior room 11 of the shoe 10 to protect the front end of the shoe 10 from being deformed. The curved portion 30 guides the rear section 3 to be accommodated in rear end of the interior room 11 of the shoe 10.

When lifting and pivoting the rear section 3 with the user's finger being inserted into the hole 321, the rear section 3 is pivoted upward relative to the front section 2, and the two notches 31 are widened. Therefore, the rear section 3 and the front section 2 are able to be pulled out from the interior room 11 of the shoe 10 in sequence. The curved portion 30 helps the rear section 3 to be easily removed from the shoe 1.

It is noted that corner portions 331 formed on the second flange of the rear section 3 are curved corner portions 331 which are cooperated with the second opening 33 to make the rear section 3 to be quickly and easily separated from the shoe 10 without being interfered by the counter or quarter located around the insertion hole of the shoe.

Figure 6:
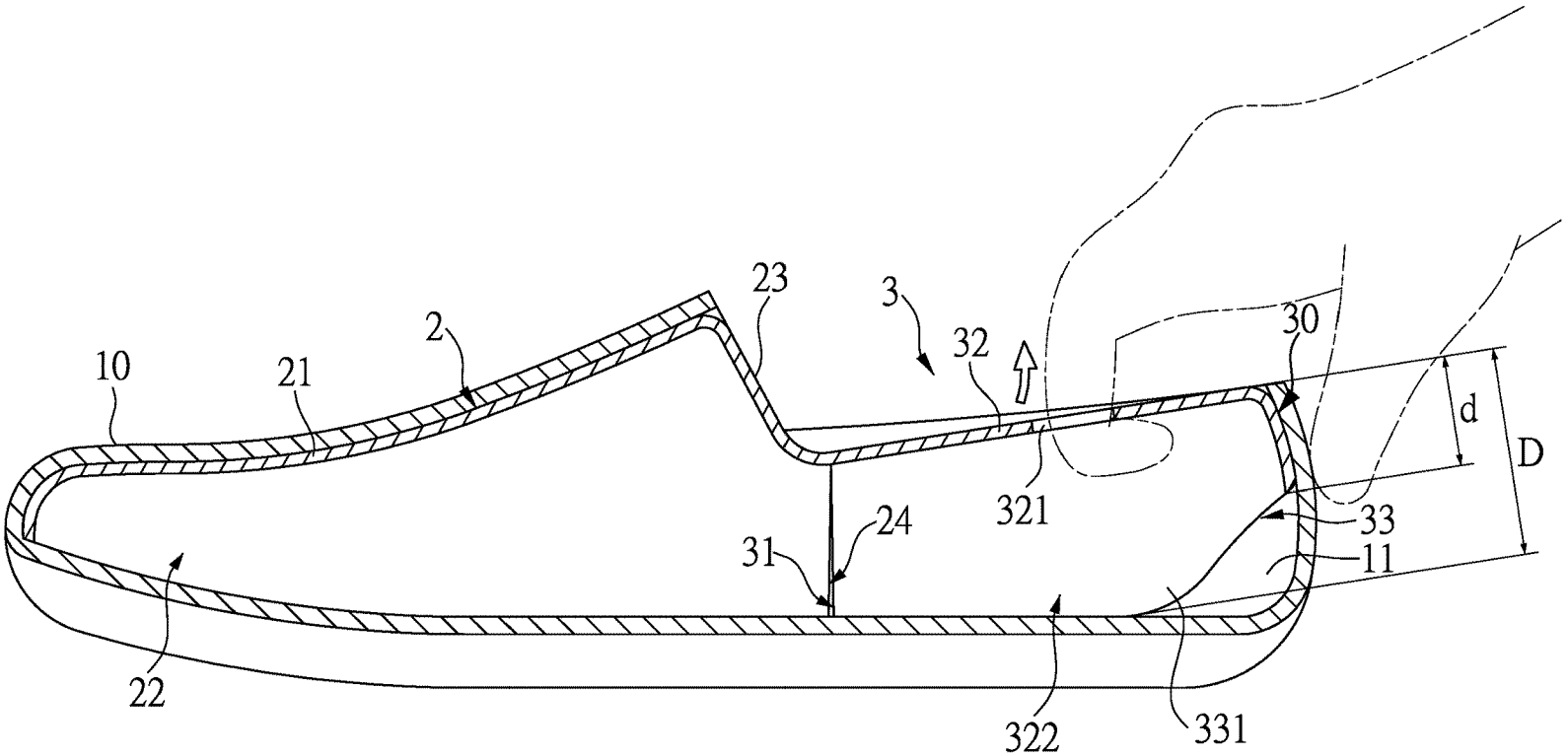
FIG. 6 shows that the user pulls the shoe tree out from the shoe.

As shown in FIG. 6, the minimum distance "d" defined between second support face 32 to the lower edge of the curved portion 30 is smaller than the maximum distance "D" defined between the second support face 32 to the lower edge of the second flange. The maximum distance "D" is larger than the minimum distance "d" makes that the rear section 3 be easily inserted into and removed from the insertion hole of the shoe 10.

The present invention can be made by recycled paper or another suitable material.

While we have shown and described the embodiment in accordance with the present invention, it should be clear to those skilled in the art that further embodiments may be made without departing from the scope of the present invention.

What is claimed is:

1. A shoe tree comprising:

a front section and a rear section which is pivotably connected to a rear end of the front section, the front section having a vamp portion on a top thereof, a first flange extending downward from the front section and a first recessed area defined in an underside of the front section and partially enclosed by the first flange, a first support face formed on the top of the rear end of the front section, a first opening defined between two end faces of the first flange in the rear end of the underside of the front section and communicating with the first recessed area;

the rear section having a first end thereof pivotably connected to the first support face at the rear end of the front section, a second flange extending downward from the rear section, two notches defined between the two end faces of the first flange and two end faces of the second flange, the two notches located at a connection portion between the first and second flanges, the rear section having a second support face formed on a top thereof and connected to the first support face, a lower edge of the second flange of the rear section extending upward and toward a second end of the of the rear section, so as to define a second opening in the second end of the underside of the rear section, a curved portion formed at the second end of the rear section;

when applying a force to the rear section, the front section is adapted to be inserted into an interior room of a shoe, and the rear section is pivoted downward relative to the front section to narrow the two notches so that the rear section is adapted to be inserted into the interior room of the shoe, the curved portion guides the rear section to be accommodated in the interior room of the shoe, and when lifting and pivoting the rear section, the two notches are widened, and the curved portion is removed from the shoe, and the rear section and the front section are adapted to be pulled out from the interior room of the shoe in sequence.

2. The shoe tree as claimed in claim 1, wherein the second support face has a hole defined therethrough, a second recessed area is defined in an underside of the rear section and partially enclosed by the second flange, the hole communicates with the second recessed area which communicates with the first recessed area and the first opening.

3. The shoe tree claimed in claim 1, wherein a minimum distance defined between second support face to a lower edge of the curved portion is smaller than a maximum distance defined between the second support face to a lower edge of the second flange.

* * * * *